United States Patent [19]

Konrath et al.

[11] 4,239,025

[45] Dec. 16, 1980

[54] RPM REGULATOR FOR FUEL INJECTION PUMPS

[75] Inventors: Karl Konrath, Ludwigsburg; Manfred Schwarz, Gerlingen, both of Fed. Rep. of Germany

[73] Assignee: Robert Bosch GmbH, Stuttgart, Fed. Rep. of Germany

[21] Appl. No.: 970,064

[22] Filed: Dec. 15, 1978

[30] Foreign Application Priority Data

Jan. 21, 1978 [DE] Fed. Rep. of Germany ..... 2802607

[51] Int. Cl.[3] ..... F02M 59/24; F02M 59/42

[52] U.S. Cl. ..... 123/366; 123/179 L; 123/387; 123/503

[58] Field of Search ..... 123/139 AZ, 198 DB, 123/140 VS, 139 BD, 140 MC, 140 CC, 139 ST, 179 L; 188/277; 267/156

[56] References Cited

U.S. PATENT DOCUMENTS

| | | | |
|---|---|---|---|
| 1,792,459 | 2/1931 | Chandler | 188/277 |
| 2,004,960 | 6/1935 | Peo | 188/277 |
| 2,777,543 | 1/1957 | O'Connor | 188/277 |
| 2,843,098 | 7/1958 | Dolza | 123/139 ST |
| 2,893,370 | 7/1959 | Winkler | 123/139 ST |
| 3,015,326 | 1/1962 | Wirsching | 123/140 CC |
| 3,146,770 | 9/1964 | Garcea | 123/140 CC |
| 3,970,064 | 7/1976 | Eheim | 123/139 AZ |
| 3,970,066 | 7/1976 | Schmitt | 123/139 BD |

FOREIGN PATENT DOCUMENTS

| | | | |
|---|---|---|---|
| 272061 | 2/1951 | Switzerland | 123/140 US |
| 872902 | 7/1961 | United Kingdom | 123/140 CC |
| 872327 | 7/1961 | United Kingdom | 267/156 |

*Primary Examiner*—Charles J. Myhre
*Assistant Examiner*—Carl Stuart Miller
*Attorney, Agent, or Firm*—Edwin E. Greigg

[57] ABSTRACT

In an rpm regulator for fuel injection pumps of internal combustion engines having a starting lever, which is coupled on one side with a delivery quantity adjustment member of the injection pump and on the other side of which an rpm tachometer contacts the starting lever with an rpm-dependent force counter to an arbitrarily variable force of a main regulator spring and also counter to the force of a starting spring which is included in series with the main regulator spring and deformable up to a particular stop, it is proposed to provide a further stop which urges the starting lever counter to the direction urged by the starting spring, whereby this second stop is adjustable in accordance with the temperature in order to regulate the starting quantity. The temperature of the coolant, of the lubrication oil, as well as that of a housing wall of the internal combustion engine may be employed for this purpose. It is also possible to employ the temperature of the inner chamber of the regulator of the injection pump itself as the regulatory value. By employing a stop element which is adjustable in accordance with temperature, the starting quantity may be increased during either cold or hot starting, since there are engines which require an increased starting quantity not only at low temperatures but also at extremely high temperatures.

13 Claims, 3 Drawing Figures

RPM REGULATOR FOR FUEL INJECTION PUMPS

BACKGROUND OF THE INVENTION

The invention relates to a fuel injection pump of the type described in the main claim such as is known, for example, from the German laid-open application No. 2 449 859 or equivalently, U.S. Pat. No. 3,970,064. In this known structure, an increased starting quantity is constantly injected during starting until a certain starting rpm has been attained, independently of the operational condition of the internal combustion engine.

It is true that it is well-known to regulate the injected starting quantity by means of adjusting a regulator member via a thermostat, for example, in accordance with the coolant temperature. However, this is not possible in the known regulator structure without very great structural expense.

OBJECT AND SUMMARY OF THE INVENTION

The present invention has as its object the creation of an rpm regulator in which the starting quantity is regulatable in accordance with the operational condition of the internal combustion engine.

The rpm regulator in accordance with the invention makes possible a particularly simple and cost-effective regulation of the starting quantity, whereby the temperature of the coolant, the lubrication oil or a housing wall of the internal combustion engine, or particularly advantageously the temperature of the inner chamber of the regulator as well, can serve as the regulatory value. The transducer pin of a temperature probe can serve directly as a stop, whereby the temperature probe and the transducer separately need to be connected with each other only via a capillary tube, so that the temperature which is used may be that at the most favorable point in the engine for regulating the starting quantity.

When the temperature of the regulator chamber is used as the basis, the stop can be adjustable in accordance with temperature in a particularly simple fashion and with the least expense by means of a bimetallic element.

Retroactive effects of the fuel remain of very little influence when the stop is a rotatable disc with an appropriately shaped outer contour which cooperates with the starting lever. The forces acting on the perimeter of the disc can then be kept particularly small, so that a high degree of precision is accomplished in the regulation. To this end, the disc can efficiently be disposed rotatably on an adjustment bolt and be rotatable via a bimetallic spring. By means of embodying the bimetallic spring as a helical bimetallic band, one end of which is firmly connected to the adjustment bolt and the other end of which is firmly connected to the disc, a long adjustment path can be obtained even at small temperature differences. To attain this object in a particularly simple fashion, the first end of the bimetallic band can be bent and held within a slot of the adjustment bolt and the disc can furthermore be provided on a sleeve rotatably guided on the adjustment bolt, whereby then the other end of the bimetallic strip is fixed on the sleeve.

In order to provide the basic setting of the stop, the adjustment bolt can be held in the regulator housing either rotationally or axially displaceably and thus can be immobilized in that position.

The invention will be better understood as well as further objects and advantages thereof become more apparent from the ensuing detailed description of a preferred embodiment taken in conjunction with the drawings.

DESCRIPTION OF THE PREFERRED EMBODIMENT

Figure 1:
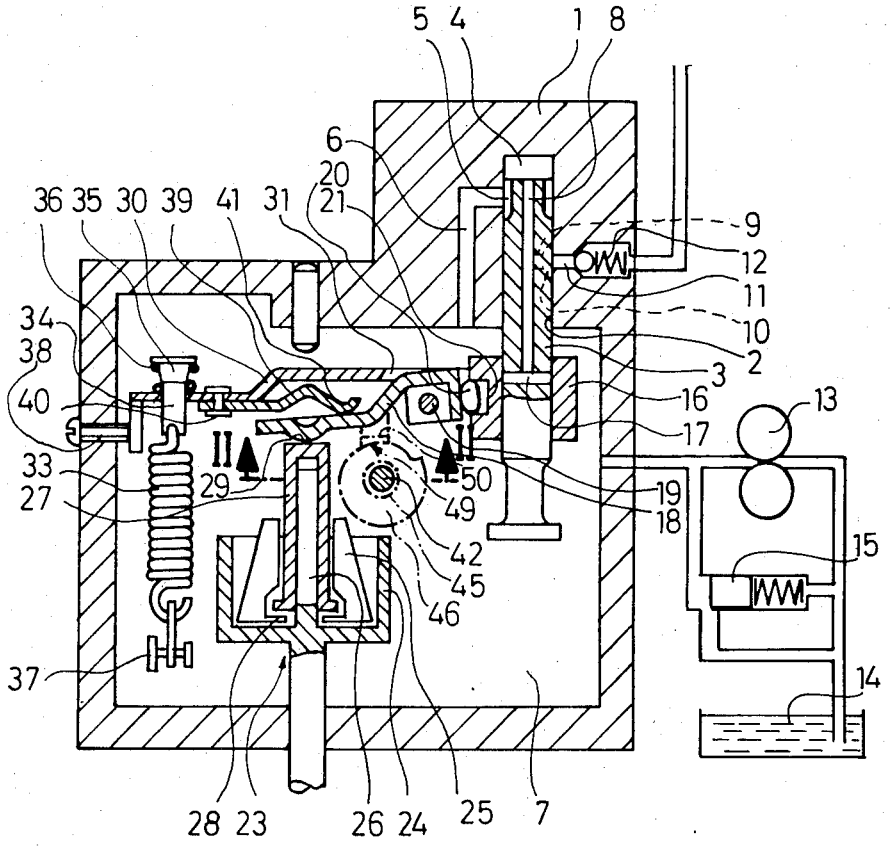
FIG. 1 is a cross-sectional view through a regulator embodied in accordance with the present invention.

In a housing 1 of a fuel injection pump, a pump piston 3 is displaceable in a simultaneous reciprocating and rotating movement in a cylinder bore 2 by conventional instrumentalities (not shown) against the force of a conventional restoring spring (not shown). The working chamber 4 of this pump is supplied with fuel from a suction chamber 7 via a longitudinal groove 5 disposed in the surface of the piston 3 and via a channel 6 disposed in the housing 1 for as long as the piston 3 makes its intake stroke and takes its lower dead center position. As soon as the channel 6 has been closed after commencement of the compression stroke and after a corresponding rotation of the piston 3, the fuel in the pump working chamber 4 is conveyed along a longitudinal channel 8 provided in the piston 3. From the longitudinal channel 8 the fuel is supplied via a branching radial bore 9 and a longitudinal distribution groove 10 disposed in the surface of the piston to one of the pressure lines 11. The pressure lines 11 are distributed at the perimeter of the cylinder bore 2 in correspondence with the number of cylinders (not shown) to be supplied. Each of the pressure lines 11 runs via a respective check valve 12 opening in the flow direction to the injection valves (not represented) of the individual cylinders of the internal combustion engine supplied by this injection pump.

The suction chamber 7 is supplied with fuel via a delivery pump 13 from a fuel storage container 14. The pressure of the fuel in the suction chamber 7 is controlled, in a manner known per se, by a pressure control valve 15 parallel to the fuel delivery pump 13. A delivery quantity adjustment member in the form of an annular slide 16 surrounds and is displaceable on the piston 3. This slide 16 controls the opening of a radial bore 17 which communicates with the longitudinal channel 8 during the compression stroke of the pump piston 3 and thus determines the end of delivery, i.e., determines the delivery quantities supplied by the pump piston 3 into the pressure lines 11. The remaining fuel delivered by the piston 3 is not supplied to the pressure lines 11 but rather flows back into the suction chamber 7.

The annular slide 16 is displaced via a starting lever 18, which is pivotable about a shaft 19 which is firmly inserted into the housing 1, and one end of the starting lever 18 projects with its head 20 into a recess 21 of the annular slide 16. A centrifugal regulator 23, serving as the rpm signal transducer, contacts the other arm of the starting lever 18. The centrifugal regulator 23, which is driven by a drive means which is not shown, has a carrier 24 on which flyweights 25 are disposed. A sleeve 27 is slidably disposed centrally on the shaft 26 and nose-like portions 28 of the flyweights 25 contact the lowermost end of the sleeve 27 so that the sleeve 27 is axially displaced on the shaft 26 by centrifugal force when the flyweights are deflected, and thus the sleeve 27 simultaneously displaces the starting lever 18 and the annular slide 16. At the point of contact with the sleeve 27, the starting lever 18 has a hemispherical projection 29 for the purpose of transferring the adjustment motion of the centrifugal regulator 23 with minimum friction and torque. This hemispherical projection could, however, equally well be located on the sleeve 27 instead. In this case, the starting lever 18 would have a smooth surface.

A one-armed drag lever 30 is pivotably disposed on the same shaft 19, independently of the starting lever 18. This lever 30 is fixed symmetrically with respect to the starting lever 18 and has a recess 31 into which the starting lever 18 projects, so that both levers 18, 30 are pivotable independently of each other. Thus, the ends of the two levers overlap each other.

A main regulator spring 33 is attached to the end of the drag lever 30. For this purpose, the main regulator spring 33, which is embodied as a rectractable spring, is fixed at one end to a bolt 34, which penetrates the drag lever 30 in a bore and has a head 35 on its opposite end. Between the head 35 and the drag lever 30, an idling spring 36 may be disposed. The other end of the main regulator spring 33 hangs on an arbitrarily adjustable lever 37. An adjustable full-load stop 38 for the drag lever 30 is also provided.

Both the drag lever 30 and the starting lever 18 are bent at angles, so that when both levers abut one another a parallelogram-like space is formed between them. In this position, both levers extend substantially parallel to one another. A leaf spring 39 projects into the space between the drag lever 30 and the starting lever 18, which leaf spring 39 in this instance is connected with the outer end of the drag lever 30 by a rivet 40, as is clearly shown in FIG. 1. The leaf spring 39 is bent substantially medially of its length at an angle away from and then back again toward the centrifugal regulator 23 and furthermore has a tongue-like end 41 bent upward, which contacts the starting lever 18. The leaf spring tends to press the two levers 18, 30 apart.

Figure 2:
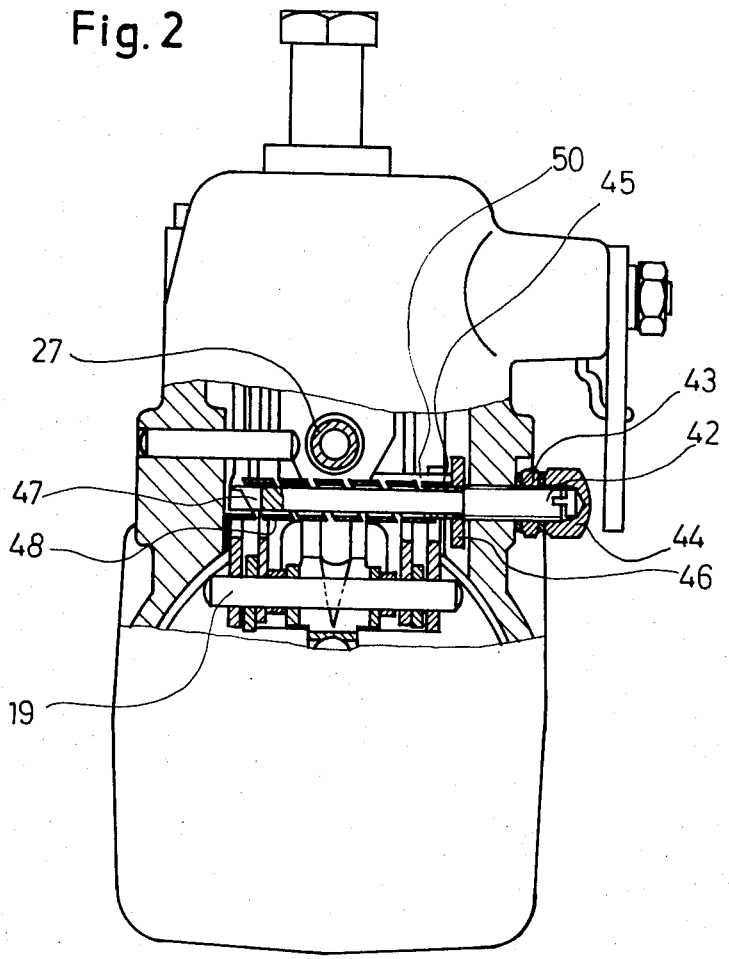
FIG. 2 is a partial cross-sectional view through the regulator shown in FIG. 1 along the line II—II.

An elongated adjustment means comprises a tubular shaft 42 which is disposed transversely relative to the pump piston 3 in the housing 1 and is adjustable via a check nut 43 (see FIG. 2) and tightly closed off by a cover cap 44. A disc 46 is rotatably fixed on a sleeve 45 on the adjustment shaft 42. The adjustment shaft 42 has a slot 47 on the end with which it projects into the suction chamber 7. In this slot 47 is held the bent end of a helical bimetallic band 48 which encompasses the adjustment shaft 42. The other end of the bimetallic band 48 is firmly connected to the sleeve 45.

When the temperature of the fuel filling the suction chamber 7 varies, the bimetallic band 48 changes in shape and thus rotates the disc 46 in a temperature-dependent manner. As a result of its outer contour, the disc 46 serves as a stop 49 (see FIG. 1) for a tongue-like projection 50 that is provided on the starting lever 18. After the engine starts, the projection 50 is lifted from the stop 49 by means of the centrifugal regulator 23 which pivots the starting lever, whenever a minimum rpm (starting switch-off rpm) which is below the idling rpm is attained. By means of appropriately selecting the contour of the disc 46, the injected starting quantity is regulated in accordance with the temperature of the fuel in the suction chamber 7. The course of the injection quantity over the rpm is plotted at various temperatures in FIG. 3. The uppermost curve corresponds to the lowest cold-starting temperature, and the curves shown below it in broken lines correspond to rising temperatures up to normal operating temperature. However, as is the case with special internal combustion engines, when the internal combustion engine is hot larger starting quantities may also be injected. All that is required then is an appropriate shape of the outer contour of the disc 46.

Figure 3:
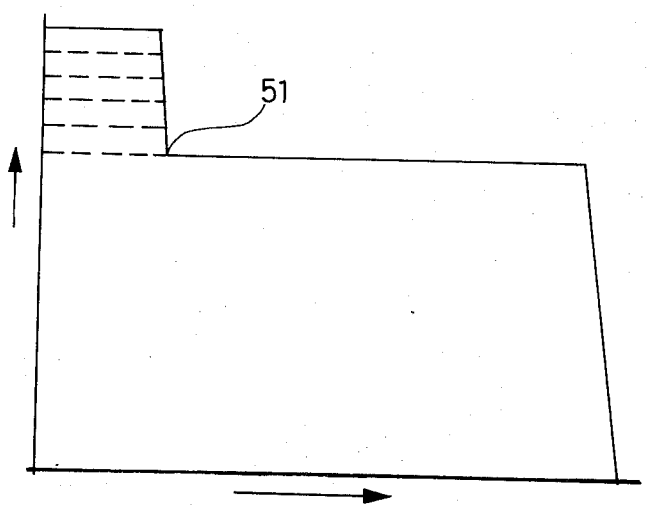
FIG. 3 is a diagram showing the injection quantity in accordance with the rpm, with curves for starting quantities at various temperatures.

The injection quantity regulation in the injection pump described above operates as follows:

Depending on the position of the annular slide 16, the radial bore 17 and thus the relieving communication of working chamber 4 and pump suction chamber 7 are opened sooner or later during the compression stroke, that is, during the delivery stroke of the pump piston 3, and thus fuel delivery into the pressure line 11 is interrupted. Thus, in the uppermost position of the annular slide 16, the maximum fuel quantity, that is, the entire fuel quantity delivered by the pump piston 3, is conveyed to the pressure lines 11. The farther downward the annular slide 16 is displaced, the earlier the radial bore 17 is opened and the fuel delivery interrupted. In the illustrated starting position, the drag lever 30 contacts the full-load stop 38, while the starting lever 18 with its projection 50 comes into contact, by means of the leaf spring 39, with the stop 49. Simultaneously with the deflection of the starting lever 18, the control slide 16 is moved into its uppermost position, which corresponds to the delivery of an excess fuel quantity equal to the starting quantity, which is influenced by the position of the stop 49 formed by the disc 46. After the engine is started, the flyweights 25 are deflected outwardly by the increasing rpm, so that the sleeve 27 is displaced upwardly and, with increasing rpm, pivots the starting lever 18 against the force of the leaf spring 39 until it abuts the drag lever 30. At this instant, the excess fuel quantity is reduced to the normal full-load quantity. In the diagram of FIG. 3, this instant is indicated by reference numeral 51. During further operation with further rpm increase, the starting lever 18 is pivoted together with the drag lever 30 at the latest, depending on the initial stressing of the main regulator spring 33, when the deregulation rpm is reached, and thereby the annular slide 16 is displaced farther downwardly. Thus, during normal operation, the drag lever 30 and the starting lever 18 are in constant contact with each other. However, the leaf spring 39 may also serve simultaneously as the idling spring. In such a case, the spring 36 would be omitted and the spring 39 would serve as the starting spring for a portion of its stroke and then serve as the idling spring for the remaining portion of its stroke.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An rpm regulator for fuel injection pumps of internal combustion engines having a starting lever, which is coupled on one side with a delivery quantity adjustment member of the injection pump and on the other side with an rpm tachometer, a drag lever to restrict starting lever movement, such that said starting lever is subjected to an rpm-dependent force that is counter to an arbitrarily variable force of a main regulator spring which engages the drag lever counter to the force of a starting spring which is arranged between the starting lever and the drag lever and is deformable up to the starting lever, such that the starting lever acts as a stop when the starting lever is against the drag lever, further wherein an additional stop means is provided which urges the starting lever counter to the direction urged by the starting spring and that this additional stop means is adjustable as a function of temperature.

2. An rpm regulator in accordance with claim 1, further wherein the stop means is adjustable as a function of coolant temperature.

3. An rpm regulator in accordance with claim 1, further wherein the temperature component is sensed from a suction chamber associated with said rpm regulator.

4. An rpm regulator in accordance with claim 3, further wherein said additional stop is adjustable in accordance with the temperature component by means of a bimetallic element.

5. An rpm regulator in accordance with claim 1, further wherein said additional stop comprises a rotatable disc with an appropriately embodied outer contour which cooperates with said starting lever.

6. An rpm regulator in accordance with claim 5, further wherein said disc is disposed on an adjustment shaft and is rotatable via a bimetallic spring.

7. An rpm regulator in accordance with claim 6, further wherein said bimetallic spring comprises a helical bimetallic band, one end of which is connected to said adjustment shaft and the other end of which is connected to said disc.

8. An rpm regulator in accordance with claim 7, further wherein said one end of the bimetallic band is bent at an angle and held in a slot of said adjustment shaft.

9. An rpm regulator in accordance with claim 6, further wherein said disc is disposed on a sleeve which is rotatably guided on said adjustment shaft and that at least one end of said bimetallic strip is fixed on said sleeve.

10. An rpm regulator in accordance with claim 6, further wherein said regulator is disposed in a housing and said adjustment shaft is held rotationally therewithin.

11. An rpm regulator in accordance with claim 6, further wherein said regulator is disposed in a housing and said adjustment shaft is held axially displaceably and immobilizably therewithin.

12. An rpm regulator in accordance with claim 1, further wherein the stop means is adjustable as a function of lubrication oil temperature.

13. An rpm regulator in accordance with claim 1, further wherein the stop means is adjustable as a function of the housing wall temperature of the internal combustion engine.

* * * * *